United States Patent [19]

Larson

[11] 4,261,324

[45] Apr. 14, 1981

[54] WOOD BURNING STOVE WITH INTEGRAL FORCED AIR HEAT EXCHANGER SYSTEM

[75] Inventor: Hal Larson, Walla Walla, Wash.

[73] Assignee: Woodcutters Manufacturing, Inc., Walla Walla, Wash.

[21] Appl. No.: 11,382

[22] Filed: Feb. 12, 1979

[51] Int. Cl.[3] ..... A24C 1/14

[52] U.S. Cl. ..... 126/67

[58] Field of Search ..... 126/66, 67, 77, 131, 126/123

[56] References Cited

U.S. PATENT DOCUMENTS

| | | | |
|---|---|---|---|
| 2,134,935 | 11/1938 | Winnett | 126/11 |
| 3,981,292 | 9/1976 | Lilly et al. | 126/123 X |
| 4,047,515 | 9/1977 | Daniel | 126/67 X |
| 4,092,976 | 6/1978 | Buckner | 126/66 X |
| 4,096,847 | 6/1978 | Mitchell | 126/66 X |
| 4,129,113 | 12/1978 | Bergstrom | 126/121 |
| 4,129,251 | 12/1978 | Goldsby et al. | 126/121 X |
| 4,166,444 | 9/1979 | Martenson | 126/123 X |

FOREIGN PATENT DOCUMENTS

| | | | |
|---|---|---|---|
| 639003 | 6/1928 | France | 126/66 |

*Primary Examiner*—Stephen D. Garbe

*Attorney, Agent, or Firm*—Chernoff & Vilhauer

[57] ABSTRACT

A stove having an integral heat exchanger and a fan unit for forcing air through the heat exchanger and into a room where the stove is situated through hot air outlet openings in the stove front which are covered by perforated ceramic decorative cover plates. The heat exchanger extends along the rear and side walls of the stove and comprises a conduit of welded sheet metal construction similar to that of the stove walls wherein portions of the stove side walls also serve as the sides of the heat exchanger conduit. The decorative cover plates are retained in position by elastically deformable wire clips which partially encircle an edge of each cover plate and frictionally engage an outwardly projecting lip surrounding the hot air outlet openings of the heat exchanger conduit.

9 Claims, 5 Drawing Figures

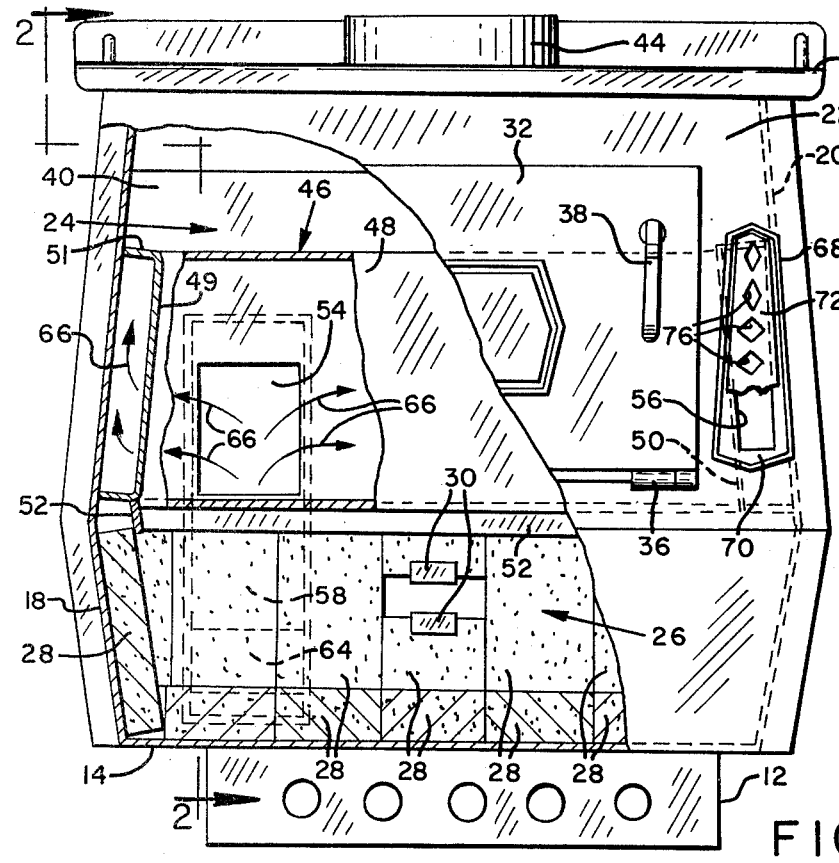
FIG. 1
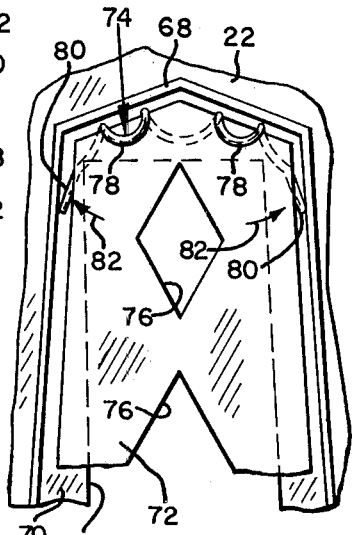
FIG. 3
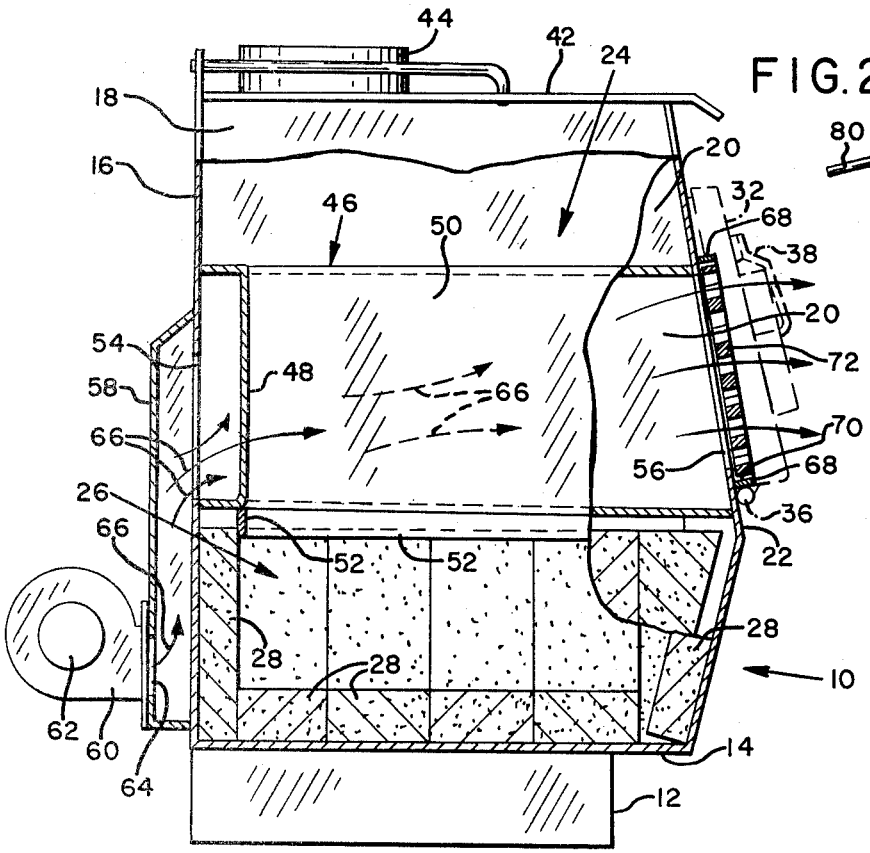
FIG. 2
FIG. 4
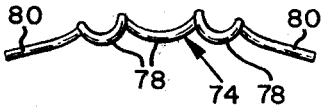
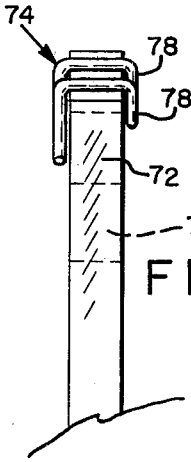
FIG. 5

WOOD BURNING STOVE WITH INTEGRAL FORCED AIR HEAT EXCHANGER SYSTEM

BACKGROUND OF THE INVENTION

The present invention relates to improvements in free-standing stoves and the like, and in particular to an integral forced air heat exchanger system for such a stove.

Coal and wood burning stoves have long been used for heating buildings, because enclosed stoves are more efficient, generally, than open fireplaces, and because wood usable as fuel is readily available in most localities. While wood remains a comparatively low-cost fuel, with the passage of time the cost of using wood as fuel has greatly increased, and, therefore, efforts have been made to increase the efficiency with which the fuel energy is used. Significant energy saving may be accomplished in the use of these stoves by the addition of a forced air heat exchanger to extract additional heat from the fire, transferring the heat thus extracted to air, and circulating the heated air through the rooms being heated. In addition to utilizing a greater portion of the energy released in the stove, circulation of heated air throughout a room provides a more even distribution of heat within the room whereby remote portions of the heated room may be kept warm without the necessity of over-heating portions of the room closest to the heating stove.

With recent very significant increases in the price of heating oil and gas, the use of wood burning stoves for heating dwellings has increased. This has brought a proliferation of new stove designs, and an increase in the importance of general outward appearance of stoves as a factor determining their marketability. While it would be possible to modify a previously designed stove which heats by radiation by adding an externally located heat exchanger and fan system to provide circulation of heated air and thus improving stove fuel-use efficiency, such addition of a heat exchanger has several disadvantages. For example, an externally added heat exchanger is unattractive in appearance, requires an unnecessarily large amount of material for its construction, is unduly expensive, and is not very efficient.

External appearance of a stove previously supplying heat only by radiation may be preserved by addition of a heat exchanger within the combustion chamber of the stove, but installation of such a heat exchanger presents problems of accomplishing airtight sealing, which is essential to prevent inclusion of harmful gases from the burning fuel in air circulated within the heated room, and to maintain regulation of the fire in an airtight stove. An additional problem presented by addition of internally located heat exchangers to existing stoves is that their presence within the combustion chamber will upset the designed convection current characteristics of the stove, reducing fuel burning and heating efficiency of the stove. In fact, since less heat output is required in modern well-insulated homes, many modern wood burning stoves are of a small size, compared to old-fashioned heating stoves, and introduction of an internally located heat exchanger would cause severe restriction of the capacity of a small stove.

As was noted, in order to be most effective, a heat exchanger requires provision of a fan or similar device to force circulation of air through a heat exchanger. While the best location for hot air outlets is in the front of such a stove, to provide heated air to the main part of a room having a stove in the customary location in a corner or end of the room, simple open pipes in the front of a stove would be unsightly.

What is needed, therefore, is a stove having a pleasing outward appearance, and including an integral forced air heat exchanger having hot air outlets which are functional yet also have a pleasing appearance.

SUMMARY OF THE INVENTION

The previously mentioned disadvantages of prior art stoves which either render them aesthetically unpleasant in appearance or limit their efficiency and safety are overcome by the present invention which provides a free-standing stove having a novel forced air heat exchanger which is enclosed within and constructed as a part of the combustion chamber and which has decorative cover plates held in position by easily removable spring clips to cover its hot air outlet openings. In the free-standing stove of the invention, a stove casing comprising four generally upstanding walls is attached to a stove base plate, and a stove top is attached to the top of the walls. Within the bottom of the stove casing a lining of refractory elements such as fire brick is provided in a firebox portion of the combustion chamber. A draft opening is provided in the rear portion of the firebox to supply combustion-supporting air to the fuel. The amount of air supplied to the fuel through the draft opening may be controlled to limit the rate of combustion of the fuel as desired for efficient fuel use.

Located inside the stove casing is a tubular heat exchanger conduit which encloses a portion of the combustion chamber. In a preferred embodiment the conduit is of vertically oriented rectangular cross-section, of which three sides are formed from a "C"-shaped channel. The channel is attached, preferably by welding, to the inner side of the rear wall and each of the side walls of the stove casing so that the stove walls form the fourth side of the conduit. The three channels are connected to form a continuous conduit, and an opening is provided through the rear wall of the stove into this heat exchanger conduit. The front ends of the side channel portions of the heat exchanger conduit abut against the stove front, and openings are provided, preferably in the stove front, in alignment with the ends of the conduit. On the outside of the rear wall of the stove a plenum encloses the previously mentioned opening into the interior of the heat exchanger conduit. A fan unit, such as an electrically driven squirrel-cage fan, is mounted on the plenum so that it forces a flow of air taken from the room into the interior of the heat exchanger conduit, forcing it to flow through the conduit around a fire contained within the combustion chamber, and out through the openings in the stove front. Such a heat exchanger conduit formed of material similar to that used for the stove walls may be easily installed during construction of the stove, although addition of such a unit to a stove after construction would be considerably more difficult.

The lower side of the rectangular conduit coincides roughly with the top of the firebox, and a metal strap extends along the bottom of the heat exchanger conduit, spaced inwardly of the stove walls, acting as a holder to retain the refractory elements which line the firebox in the desired position. Each of the side channels of the heat exchanger conduit extends vertically over a considerable portion of the combustion chamber above the firebox in order to present a large amount of surface area to transfer heat from the fire in the combustion chamber to the air within the heat exchanger.

The openings in the stove front are of a smaller size than the cross-sectional area of the side channels and a decorative cover plate is located over each hot air outlet opening, on the exterior side of the stove front. The cover plate is retained in its position by a self-biased clip of spring wire which is medially formed to engage the edge of the cover plate, while its ends are elastically biased apart from each other to frictionally engage the interior of a forwardly protruding raised lip which surrounds each hot air outlet opening in the stove front. Each decorative cover plate, preferably of ceramic material, has a plurality of openings, allowing heated air to exit from the heat exchanger conduit through a total open area which is less than the area of the heat exchanger conduit. This allows the fan unit to establish an air pressure within the heat exchanger which is greater than that without, so that the escaping heated air is given a relatively high velocity which assures circulation of the heated air within the room.

The easily-removable ceramic decorative cover plate allows easy access to the interior of the heat exchanger conduit when desired for inspection or cleaning of the heat exchanger conduit, and the use of a spring clip to retain the cover plate in position over the hot air outlet openings allows the use of cover plates made of ceramic material which would be subject to damage during removal or replacement if retained by ordinary fasteners such as screws or rivets, yet which is desirable because of its appearance and because of the relative ease of maintaining glazed ceramic surfaces in a clean condition.

It is therefore a primary objective of the present invention to provide an improved solid-fuel burning stove having a pleasing aesthetic appearance and capable of providing forced circulation of heated air within a room heated by such a stove.

It is a further objective of the present invention to provide such a stove in which manufacture of the heat exchanger is integral with manufacture of the stove so that material is not wasted in construction of a heat exchanger for addition to an already existing stove.

It is another objective of the invention to provide a stove having easily removable decorative ceramic cover plates over the hot air outlet openings of a heat exchanger contained within such a stove.

It is a feature of the present invention that the cover plates over the hot air outlet openings are retained by a unique frictional retention device.

The foregoing and other objectives, features and advantages of the invention will be more readily understood upon consideration of the following detailed description of the invention, taken in conjunction with the accompanying drawings.

BRIEF DESCRIPTION OF THE DRAWINGS

FIG. 1 is a partially cut away front view of an exemplary stove embodying the invention.

FIG. 2 is a sectional side view, partially cut away, of the stove taken along line 2—2 of FIG. 1.

FIG. 3 is a fragmentary front view of the front of the stove of FIG. 1, showing the manner of attachment of a decorative cover plate over a hot air outlet opening.

FIG. 4 is a front view of a cover plate retainer clip such as the one shown in FIG. 3.

FIG. 5 is a side view of a cover plate retaining clip in position on a cover plate.

DETAILED DESCRIPTION OF THE PREFERRED EMBODIMENT

Referring to FIGS. 1 and 2, a free-standing stove 10 includes an integral forced air heat exchanger system embodying the present invention. The stove 10 is preferably of welded heavy gauge sheet metal construction, and comprises a pedestal base 12 which supports a bottom plate 14. A rear wall 16, a left side wall 18, a right side wall 20, and a stove front 22 are attached to and extend generally upwardly from the bottom plate 14. A stove top 42, sealingly connected to the rear wall, side walls and stove front, includes a vertical stove pipe connection 44, although the stove pipe connection could also be a horizontal connection included in the rear wall 16 of the stove. Thus an enclosed combustion chamber 24 is formed whose lower portion provides a firebox 26 which is lined with refractory elements 28. Draft openings 30 are defined in the rear wall 16, and a door 32 which closes a doorway opening in the stove front 22, is releasably attached, for example, by hinges 36 and may be secured in a closed position by a latch 38.

Within the combustion chamber 24 is located a heat exchanger conduit 46 which is constructed integrally with the stove 10. The heat exchanger conduit comprises a rear channel 48, which extends laterally along the rear wall 16 above the vertically oriented refractory elements 28 located along the rear wall of the firebox 26, and a pair of side channels, a left channel 49 which extends from the left extremity of the rear channel forwardly along the left side wall 18 and a right channel 50 which extends from the right extremity of the rear channel forwardly along the right side wall 20 of the stove to the stove front 22. Each of the side channels and the rear channel is preferably constructed of heavy gauge sheet metal similar to that used for construction of the stove walls. The channels each have a flat-sided "C"-shaped cross section and are welded to each other and to the respective walls and front of the stove providing an airtight separation between the interior of the combustion chamber and the interior of the heat exchanger conduit to prevent combustion chamber gases from entering into the heat exchanger conduit. Each of the channels is of a uniform depth which approximates the thickness of the refractory elements 28, so that the interior surfaces of the combustion chamber extends upwardly over the conduit in a fairly uniform manner. This also allows the refractory elements to be simply and securely located within the stove firebox 26 by first installing the vertically oriented elements and thereafter installing the horizontally oriented elements.

A metal strap is attached along the lower interior edge of the heat exchanger conduit and extends downwardly from it, forming a holder 52 which secures the vertically extending refractory elements 28 in their proper locations along the sides of the firebox 26.

A cool air inlet opening 54 is defined in the rear wall 16 of the stove in an area covered by the rear channel 48, and a hot air outlet opening 56 is defined in each side of the stove front in a position covered by the respective side channel. A plenum 58 is attached on the outside of the rear wall 16 of the stove in a position covering the cool air inlet opening 54, and a fan unit 60 is fixedly connected to the plenum 58 such that air may be taken into the fan through a fan intake 62 and forced by the fan through a plenum inlet 64 defined in the plenum 58. The air then flows as indicated by the arrows 66 from the plenum through the cool air inlet opening into the heat exchanger 46, where the flow then divides within the rear channel, a portion of the air proceeding through each of the side channels 49 and 50, to the hot air outlet openings 56, absorbing heat from a fire within the combustion chamber during the flow through the heat exchanger.

The hot air outlet openings 56 are smaller in size than the cross-sectional areas of the side channels, and each of the hot air outlet opening 56 is surrounded by an outwardly protruding lip 68 which defines a recess 70 within which a decorative cover plate 72 of ceramic material is retained by clips 74 located respectively at the top and the bottom of each cover plate 72. Each decorative cover plate comprises a plurality of openings 76 which allow heated air to pass outwardly from the heat exchanger 46.

Referring now also to FIGS. 3 through 5, the means of attachment of the decorative cover plates may be seen in greater detail. Each clip 74 comprises a plurality of curved overhanging portions 78 which fit snugly over the edge of the decorative cover plate, and opposed end portions 80 which are elastically biased outwardly toward the positiion shown in FIG. 4. Accordingly when it is inserted within the recess 70, the clip exerts an outward force as indicated by arrows 82 in FIG. 3, to frictionally engage the inner portion of the lip 68, thus retaining the cover plate 72 within the recess 70.

In operation of the stove of the invention, the fan unit 60 forces air through the heat exchanger 46 as previously explained, extracting a greater amount of heat from a fire contained within the combustion chamber than is possible through simple radiation from the outer surfaces of the stove 10. The construction of the heat exchanger integrally with the stove preserves the outward aesthetic appearance of the stove at the same time that it ensures efficient heat transfer from the fire to air forced through the heat exchanger. Also by using the walls of the stove as the outer wall of the heat exchanger conduit the cost of constructing the conduit is decreased and a weight saving is realized.

Since the interior dimensions of the heat exchanger are such that it generally extends continuously upwardly from the refractory elements 28, the slight inward tilt of the side walls 18 and 20 and the side channels 50 helps provide good contact between the expanding heated gases of the fire and the heat exchanger 46.

The stove 10 is preferably of so-called "airtight" construction in which the air is allowed to enter the combustion chamber only through the draft openings 30, which may be restricted to limit the amount of air available for burning fuel, thus controlling the rate of combustion of fuel. The capacity of the forced air heat exchanger to extract heat from a fire which is controlled in size by the features of the airtight construction of the stove increases both the total efficiency of fuel use in the stove and the comfort provided by the stove, since the circulation of air provided by the fan unit provides a more even distribution of heat to the rooms heated by the stove than is the case with simple radiant heating.

The decorative cover plates 72 covering the hot air outlet openings 56 provide a further restriction of the flow of air outward from the heat exchanger 46 than is provided by the size of the hot air outlet openings 56. This ensures development of a slight pressure within the heat exchanger, so that the air fully fills the conduit to provide maximum exposure to its heated walls. This also provides a relatively high velocity of air exiting through the decorative cover plates, to aid circulation of the heated air through a large space. The use of the clips 74 to retain the decorative cover plates over the hot air outlet openings allows the safe use of decorative cover plates made of ceramic material which would not be easily attachable or detachable with normal fasteners such as screws or rivets without the risk of breakage. Thus decorative use of the ceramic cover plates 72 may be made, and easy removal of the cover plates for inspection or cleaning of the interior of the heat exchanger is provided.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A free-standing stove, comprising:

(a) combustion chamber means for containing a fire, said combustion chamber means comprising a plurality of generally upstanding walls;

(b) heat exchanger means, located within said combustion chamber means, for transferring heat from a fire within said combustion chamber means to air within said heat exchanger means, said heat exchanger means comprising:

(i) a heat conductive open-sided channel sealingly attached to said walls of said combustion chamber means and covering a portion of said walls so as to define a hollow conduit which includes as a part thereof portions of said walls of said combustion chamber means;

(ii) a cool air inlet opening defined in one of said walls of said combustion chamber means and arranged to open into said channel;

(iii) hot air outlet means defined in one of said walls of said combustion chamber means located in a portion of said wall which is covered by said channel for directing heated air from said heat exchanger conduit in a predetermined direction;

(c) fan means associated with said heat exchanger means for forcing a quantity of air into said heat exchanger means through said cool air inlet opening.

2. The stove of claim 1 wherein said combustion chamber means comprises a rear wall and a pair of opposing side walls and said heat exchanger means extends continuously along all of said rear and side walls as a single continuous hollow conduit.

3. The stove of claim 2 further comprising a generally upstanding front wall, wherein said heat exchanger means abuts against and is sealingly connected to said front wall, and said hot air outlet means comprises an opening defined in said front wall in alignment with said hollow conduit.

4. The stove of claim 1 wherein the area of said hot air outlet opening is smaller than the cross-sectional area of said hollow conduit at a location adjacent to said hot air outlet means.

5. The stove of claim 1 including holder means for retaining refractory elements in a desired location within said combustion chamber, said holder means comprising a bar fixedly attached to said heat exchanger means a predetermined distance from said walls of said combustion chamber means, said bar extending below said heat exchanger means so as to engage said refractory elements.

6. A free-standing stove, comprising:

(a) Combustion chamber means for containing a fire, said combustion chamber means comprising a plurality of generally upstanding walls;

(b) heat exchanger means, located within said combustion chamber means, for transferring heat from a fire within said heat exchanger means, said heat exchanger means comprising:

(1) a heat conductive open-sided channel sealingly attached to said walls of said combustion chamber means and covering a portion of said walls so as to define a hollow conduit which includes as a part thereof portions of said walls of said combustion chamber means;

(2) a cool air inlet opening defined in one of said walls of said combustion chamber means and arranged to open into said channel;

(3) hot air outlet means defined in one of said walls of said combustion chamber means located in a portion of said wall which is covered by said channel for directing heated air from said heat exchanger conduit in a predetermined direction;

(c) an outwardly protruding lip located on the exterior of said stove, said lip surrounding said hot air outlet opening, and a perforated decorative cover plate and attachment means for releasably mounting said decorative cover plate within said lip; and (d) fan means associated with said heat exchanger means for forcing a quantity of air into said heat exchanger means through said cool air inlet opening.

7. The stove of claim 6 wherein said attachment means includes elastically deformable clip means for retaining said decorative cover plate in position within said lip including gripping means for releasably holding said cover plate and engagement means for frictionally engaging said lip.

8. The stove of claim 7 wherein said gripping means comprises a curved wire spring including a plate-gripping portion engagingly extending around an edge of said cover plate, and said engagement means comprises an end portion elastically biased toward said lip for frictionally engaging said lip.

9. The stove of claim 7 wherein said decorative cover plate is of ceramic material.

* * * * *